US009419400B2

(12) United States Patent
Morikawa

(10) Patent No.: US 9,419,400 B2
(45) Date of Patent: Aug. 16, 2016

(54) METHOD OF MANUFACTURING A CHAINED TERMINAL

(71) Applicant: Yazaki Corporation, Minato-ku (JP)

(72) Inventor: Taishi Morikawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 190 days.

(21) Appl. No.: 14/205,884

(22) Filed: Mar. 12, 2014

(65) Prior Publication Data

US 2014/0190008 A1 Jul. 10, 2014

Related U.S. Application Data

(62) Division of application No. 13/387,896, filed as application No. PCT/JP2010/062955 on Jul. 30, 2010, now abandoned.

(30) Foreign Application Priority Data

Jul. 31, 2009 (JP) ..... 2009-179091

(51) Int. Cl.
*H01R 43/04* (2006.01)
*H01R 43/048* (2006.01)
(Continued)

(52) U.S. Cl.
CPC ..... *H01R 43/048* (2013.01); *H01R 43/0482* (2013.01); *H01R 43/16* (2013.01); *H01R 9/05* (2013.01); *H01R 13/11* (2013.01); *Y10T 29/49185* (2015.01)

(58) Field of Classification Search
CPC .. H01R 4/2466; H01R 43/048; H01R 43/055; H01R 43/058; H01R 43/16; H01R 43/02; H01R 4/62; Y10T 29/49218; Y10T 29/49204; Y10T 29/53235; Y10T 29/49181; Y10T 29/49185; B21D 39/048
USPC ..... 29/882, 861, 863, 874
See application file for complete search history.

(56) References Cited

U.S. PATENT DOCUMENTS 3,072,880 A 1/1963 Olsson
3,473,219 A 10/1969 Randar et al.
(Continued)

FOREIGN PATENT DOCUMENTS

CN 1239341 A 12/1999
CN 1387288 A 12/2002
(Continued)

OTHER PUBLICATIONS

International Search Report (PCT/ISA/210) issued on Sep. 7, 2010 in the International Patent Application No. PCT/JP2010/062955.
(Continued)

*Primary Examiner* — Thiem Phan
(74) *Attorney, Agent, or Firm* — Sughrue Mion, PLLC

(57) ABSTRACT

The invention provides a terminal chain so that a terminal can be connected with a signal conductor only by being press-formed by dies. A rectangular piece (12) is jointed to an end part extending in the longitudinal direction of a carrier (11). The rectangular piece (12) is placed in dies (40, 50) for press-forming. A signal conductor W1 exposed at one end of a wire W is placed on the rectangular piece (12). The rectangular piece (12) is press-formed by the dies (40, 50) to enclose the signal conductor W1. A terminal (20) which is connected with the signal conductor W1 is formed. The contacting position of the carrier (11) and the terminal (20) is disconnected.

5 Claims, 7 Drawing Sheets

(51) Int. Cl.

| | |
|---|---|
| ***H01R 43/16*** | (2006.01) |
| *H01R 9/05* | (2006.01) |
| *H01R 13/11* | (2006.01) |

(56) References Cited

U.S. PATENT DOCUMENTS

| | | | |
|---|---|---|---|
| 3,530,428 | A | 9/1970 | Zak |
| 3,849,860 | A | 11/1974 | Zahn et al. |
| 4,776,651 | A | 10/1988 | Paulo |
| 4,934,964 | A | 6/1990 | Mazelle |
| 5,067,916 | A | 11/1991 | Denlinger et al. |
| 5,340,337 | A | 8/1994 | Pentz |
| 6,098,285 | A | 8/2000 | Tsuji |
| 6,141,872 | A | 11/2000 | Takanashi et al. |
| 7,226,323 | B2 | 6/2007 | Noro et al. |
| 2006/0211312 | A1 | 9/2006 | Noro et al. |

FOREIGN PATENT DOCUMENTS

| | | | |
|---|---|---|---|
| CN | 1835294 | A | 9/2006 |
| EP | 0 966 074 | A2 | 12/1999 |
| JP | S59138080 | A | 8/1984 |
| JP | 6-68321 | | 9/1994 |
| JP | 7320843 | A | 12/1995 |
| JP | H1092546 | A | 4/1998 |
| JP | 20003773 | A | 1/2000 |
| JP | 2003317882 | A | 11/2003 |
| JP | 2006260978 | A | 9/2006 |
| JP | 2006302790 | A | 11/2006 |
| JP | 2008159312 | A | 7/2008 |
| JP | 2009164066 | A | 7/2009 |
| WO | 2012008524 | A1 | 1/2012 |

OTHER PUBLICATIONS

Written Opinion (PCT/ISA/237) issued on Sep. 7, 2010 in the International Patent Application No. PCT/JP2010/062955.

Search Report dated Apr. 23, 2013, issued by the European Patent Office in counterpart European Patent Application No. 10804573.3.

Extended European Search Report dated Dec. 17, 2013 issued by the European Patent Office in counterpart European Patent Application No. 13005308.5.

Communication dated Dec. 20, 2013 from the State Intellectual Property Office of P.R. China in a counterpart application No. 201080034060.5.

Notice of Reasons for Refusal dated Feb. 14, 2014 issued by the Japanese Patent Office in counterpart European Patent Application No. 2013-162521.

Office Action dated May 28, 2015, issued by the European Patent Office in counterpart European Patent Application No. 13005308.5.

Communication, Dated Jul. 22, 2014, Issued by the Japanese Patent Office, In counterpart Japanese Application No. 2013-162521.

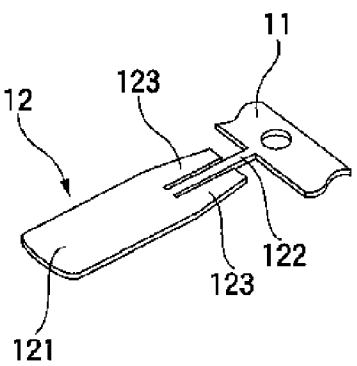
Fig. 1A
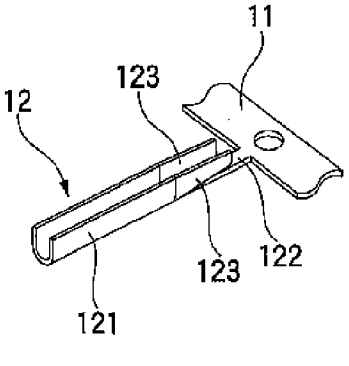
Fig. 1B
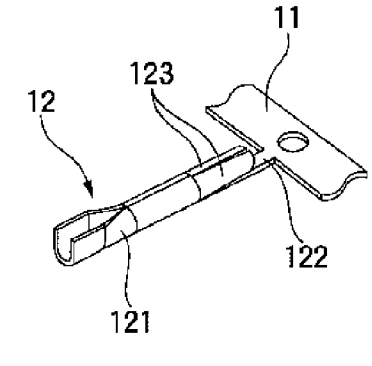
Fig. 1C
Fig. 1D
Fig. 1E
Fig. 1F

METHOD OF MANUFACTURING A CHAINED TERMINAL

CROSS-REFERENCE TO RELATED PATENT APPLICATION

This is a Divisional Application of U.S. application Ser. No. 13/387,896 filed on Jan. 30, 2012, which claims priority from PCT/JP2010/062955 filed on Jul. 30, 2010, which claims priority from Japanese Patent Application No. 2009-179091, filed on Jul. 31, 2009 in the Japanese Intellectual Property Office the disclosures of which are incorporated herein in their entirety by reference.

TECHNICAL FIELD

The invention is related to a terminal which is connected to a cable with a shielded conductor such as a coaxial cable, especially to a structure of a terminal chain by which a terminal and a signal conductor can be connected easily and a connecting method of the terminal and the signal conductor.

BACKGROUND ART

Conventionally, as disclosed in PTLs 1, 2 and 3, when a signal conductor of a cable with a shielded conductor such as a coaxial cable is connected to a terminal, the signal conductor is crimped by a barrel formed to the terminal (a crimping barrel 31b in the PTL 1, a crimping piece 32d in the PTL 2 and a crimping piece 11c in the PTL 3).

CITATION LIST

Patent Literature

[PTL 1] JP-A-2008-159312
[PTL 2] JP-A-2006-302790
[PTL 3] JP-A-2003-317882

SUMMARY OF INVENTION

Technical Problem

However, when the barrel is crimped to connect the signal conductor to the terminal as described above, it is necessary to remove from a die the terminal formed by press-forming, and place the terminal in a terminal crimping device which includes an anvil and a crimper.

The invention was made in view of the fact described above. The purpose of the invention is to provide a terminal chain so that it is possible for a terminal to be connected with a signal conductor only by being press-formed by dies.

Solution to Problem

To achieve the purpose described above, the terminal chains according to the invention are characterized by the (1)-(4) below.

(1) A terminal chain, comprising:

a carrier; and a plurality of rectangular pieces which are connected to an end part extending in a longitudinal direction of the carrier, wherein each of the rectangular pieces is press-formed so as to enclose a signal conductor exposed at one end of a wire, so that each of the rectangular pieces is formed to be a hollow cylindrical terminal.

(2) The terminal chain according to above (1), wherein each of the rectangular pieces is connected to the end part of the carrier by a carrier link that joints the end part of the carrier and an end part of the rectangular piece, and the carrier link is shaped so that the rectangular piece is placed in a position higher than a plane containing the carrier.

(3) The terminal chain according to above (1), wherein a width of the carrier is shorter than a length of an exposed portion of the signal conductor in a longitudinal direction thereof.

(4) The terminal chain according to above (1), wherein the carrier includes a narrow part a width of which is shorter than a length of an exposed portion of the signal conductor in a longitudinal direction thereof, and a wide part a width of which is longer than a dimension of the narrow part in a width direction thereof, and wherein the rectangular piece is connected to the end part at the narrow part.

According to the terminal chain with the configuration of the above (1), the process for press-forming into the shape of a terminal and the process for connecting a signal conductor of the wire with the terminal can be performed simultaneously during the process for press-forming.

According to the terminal chains with the configurations of the above (2)-(4), since the position where the carrier and the rectangular piece are disconnected can be located at the rear end of the terminal, a burr that would hinder efficient contact of the front end of the terminal with the counterpart terminal can be prevented from being formed.

Advantageous Effects of Invention

According to the terminal chain of the invention, a terminal can be connected with a signal conductor only by being press-formed by dies.

The invention is explained in brief above. Further, details of the invention will become more apparent after the embodiments of the invention described below are read with reference to the accompanying figures.

BRIEF DESCRIPTION OF DRAWINGS

FIGS. 1A to 1F are figures showing a series of process for press-forming a terminal of the first embodiment of the invention.

FIG. 5A is a top view before a terminal is disconnected, and FIG. 5B is a top view of the terminal after the terminal is detached from the terminal chain.

FIG. 7A is a top view before a terminal is disconnected, and FIG. 7B is a top view of the terminal after the terminal is detached from the terminal chain.

DESCRIPTION OF EMBODIMENTS

First Embodiment

Figure 2A:
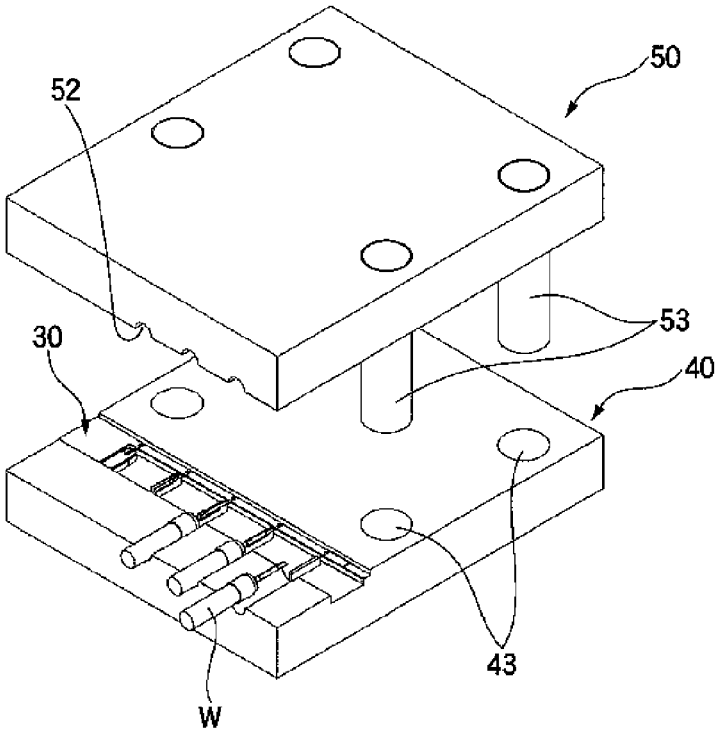
FIG. 2A is a perspective view of dies for manufacturing the terminal chain of the first embodiment of the invention.

The forming processes of a terminal of the first embodiment of the invention, together with changes of the shape of the terminal, are explained with reference to FIGS. 1A to 1F. FIGS. 1A to 1F are figures showing a series of process for press-forming the terminal of the embodiment of the invention.

First, as shown in FIG. 1A, a belt-shaped carrier 11 and a rectangular piece 12 which is connected to an end part extending in the longitudinal direction of the carrier 11 are formed by placing a flat metal plate in a die block M1 for press-disconnecting and pressing the flat metal plate (details of die blocks will be described later). Then, the rectangular piece 12 is constructed of a rectangular piece body 121 which is press-formed to enclose a signal conductor of a wire to conduct with the signal conductor as described later, a carrier link 122 which joints the rectangular piece body 121 and the carrier 11, and contacts 123 which extend from one end of the rectangular piece body 121 facing the carrier 11 towards the carrier 11. The contacts 123 are two contacts that extend at two sides of the carrier link 122 towards the carrier 11. In addition, when the rectangular piece 12 becomes a terminal, the contacts 123 will form the front end of the terminal (a portion in contact with a counterpart terminal). Hereinafter, for the rectangular piece 12 which is connected to the carrier 11 through the carrier link 122, a side that is near the carrier 11 is called a front end side, and a side that is far from the carrier 11 is called a rear end side.

Then, the rectangular piece 12 which is press-disconnected by the die block M1 is placed in a die block M2 for press-forming and is pressed. In FIG. 1B, in the rectangular piece 12, the two parts of the rectangular piece body 121 that hold the carrier link 122 and the two contacts 123 are folded towards the center of the rectangular piece body 121 that is connected to the carrier link 122. Then, the rectangular piece 12 is formed to have a cross section of a substantial U shape whose bottom edge is the center part of the rectangular piece body 121, and the parts beside the center part of the rectangular piece body 121 are erected from the two sides of the center part, respectively.

Then, the rectangular piece 12 which is press-formed by the die block M2 is placed in a die block M3 for press-forming and is pressed. In FIG. 1C, in the rectangular piece 12, the nearly half part of the rectangular piece body 121 that is near the front end side is closed. In other words, the rectangular piece body 121 is press-formed by making close the nearly half part of the rectangular piece body 121 that is near the front end side among the two nearly half parts of the rectangular piece body 121. On the other hand, the nearly half part of the rectangular piece body 121 that is near the rear end side is open at the top as in FIG. 1B, or in other words, the parts besides the center of the rectangular piece body 121 are raised from the two sides of the center of the rectangular piece body 121, respectively, to form a substantial U shape.

In FIG. 1D, a signal conductor W1 which is exposed at one end of a wire W is placed on the rear end part of the rectangular piece body 121. Since the nearly half part of the rectangular piece body 121 that is near the rear end side is opened at the top of the rectangular piece body 121, the signal conductor W1 can be placed on the center of the rectangular piece body 121.

Thereafter, the rectangular piece 12, which is press-formed by the die block M3 and whose rectangular piece body 121 carries the signal conductor W1, is placed in a die block M4 for press-forming and is pressed. As shown in FIG. 1E, the nearly half part of the rectangular piece body 121 of the rectangular piece 12 that is near the rear end side on which the signal conductor W1 of the wire W is placed is closed. In other words, the rectangular piece body 121 is formed by making close the nearly half part of the rectangular piece body 121 that is near the rear end side among the two nearly half parts of the rectangular piece body 121.

Through the processes shown in FIGS. 1A to 1E described above, the signal conductor W1 of the wire W is connected to the rectangular piece body 121, and the rectangular piece 12 is formed to the shape of a terminal at the same time. Thereafter, the rectangular piece 12 which is press-formed by the die block M4 is placed in a die block M5 for press-disconnecting, and as shown in the FIG. 1F, the carrier link 122 is disconnected. Thus, a terminal 20 which is connected to the signal conductor W1 of the wire W is formed.

Above, according to the terminal of the embodiment of the invention, the process for press-forming the rectangular piece 12 to the shape of the terminal and the process for connecting the signal conductor W1 of the wire W with the terminal can be performed at the same time. In other words, it is not necessary as before to remove from the die the terminal which is formed by press-forming, and place the terminal in a terminal crimping device which includes an anvil and a crimper. For this reason, the producing of wires to which terminals are attached can be improved, and a higher operating efficiency can be achieved.

Figure 2B:
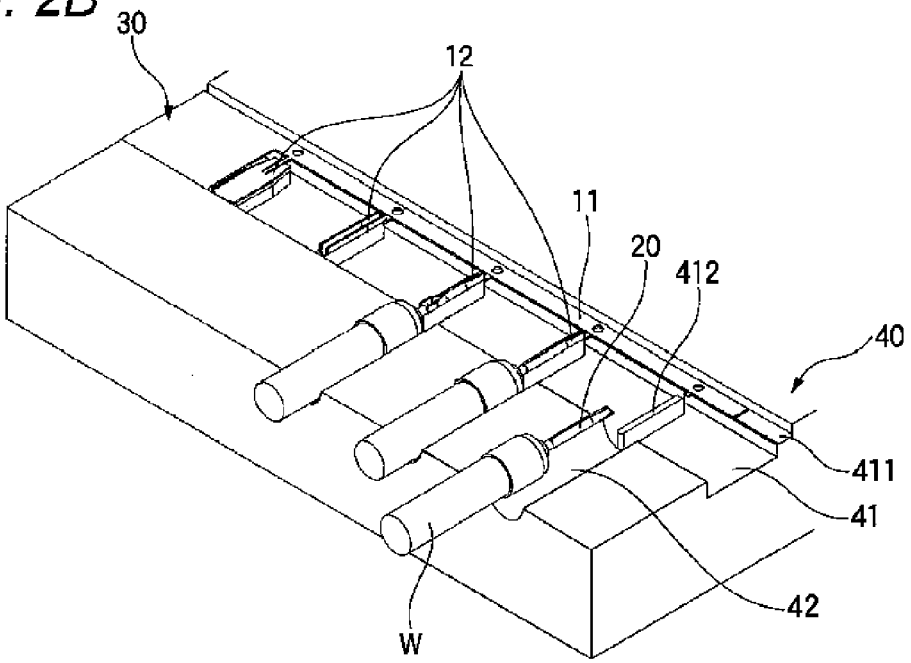
FIG. 2B is an enlarged view of main parts of FIG. 2A.

Next, a terminal chain manufacturing method which is applicable to the structure of the terminal of the first embodiment of the invention is explained with reference to FIGS. 2A and 2B. FIG. 2A is a perspective view of dies for manufacturing the terminal chain of the first embodiment of the invention, and FIG. 2B is an enlarged view of main parts of FIG. 2A.

As shown in FIG. 2A, a lower die 40 and an upper die 50 are used to manufacture a terminal chain 30. A terminal accommodating groove 41 on which the terminal chain 30 are carried, wire accommodating grooves 42 for accommodating wires W to prevent the wires W from being crushed when the upper die 50 falls, and boss holes 43 for accommodating bosses 53 of the upper die 50 are formed in the lower die 40.

Figure 3:
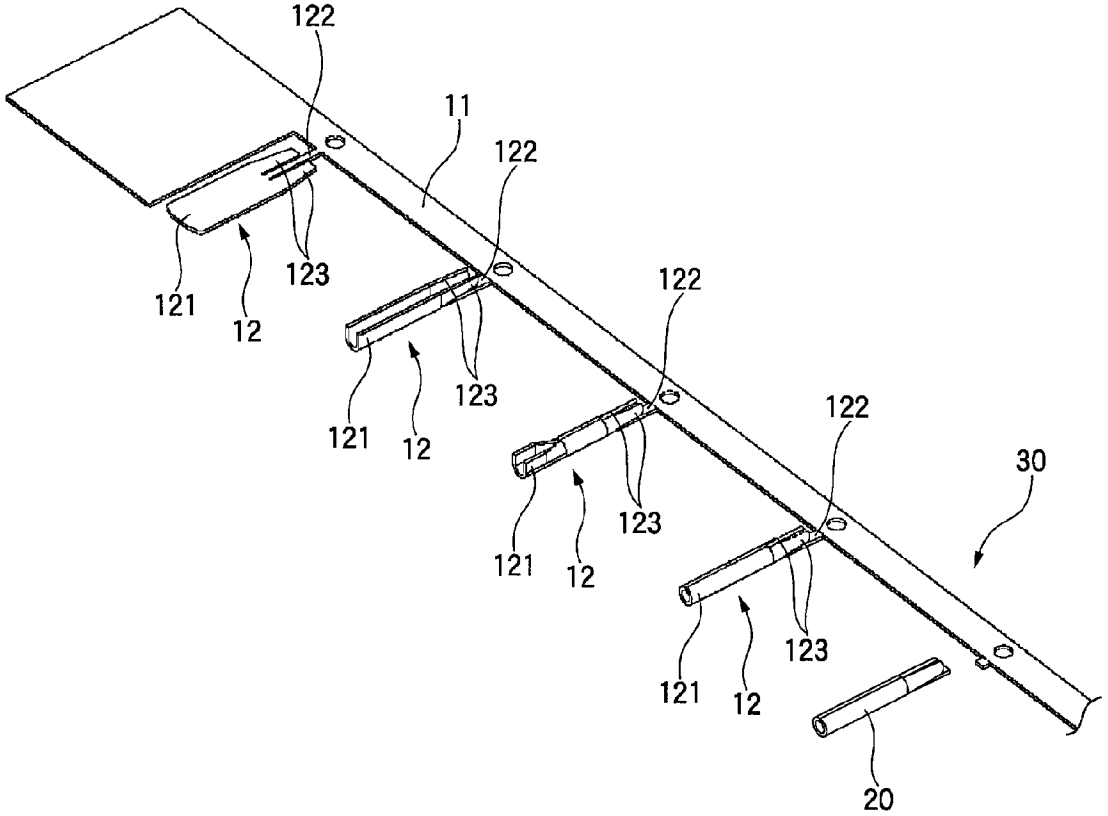
FIG. 3 is a perspective view of a terminal chain of the first embodiment of the invention.

In particular, a carrier base 411 on which the carrier 11 of the terminal chain 30 is carried is formed in the terminal accommodating groove 41. A plurality of rectangular piece bases 412 on which the rectangular pieces 12 of the terminal chain are carried are formed in the terminal accommodating groove 41 to bridge the carrier base 411 and respective wire accommodating grooves 42. In the five rectangular piece bases 412 shown in FIG. 2B, the left side rectangular piece base 412 in the figure corresponds to the die block M1 for press-disconnecting, the rectangular piece base 412 on the right of the left side one corresponds to the die block M2 for press-forming, the rectangular piece base 412 on the right of the above two corresponds to the die block M3 for press-forming, the rectangular piece base 412 on the right of the above three corresponds to the die block M4 for press-forming, the rectangular piece base 412 on the right of the above four corresponds to the die block M5 for press-disconnecting, respectively. All of the die blocks M1 to M5 were described when FIGS. 1A to 1F were explained. The die blocks are forms formed for each of the rectangular piece bases 412, respectively, and their shapes depend on the rectangular piece bases 412. The shape of the rectangular piece base 412 of the die block M1 is a shape formed by digging out the shape of the rectangular piece 12 which includes the rectangular piece body 121, the carrier link 122 and the contacts 123 from a flat metal plate. The shapes of the rectangular piece bases 412 of the die blocks M2 to M4 are shapes suitable for folding the rectangular piece body 121 of the rectangular piece 12. The shape of the rectangular piece base 412 of the die block M5 is a shape suitable for disconnecting the carrier link 122. In accordance with the aligned die blocks M1 to M5, the respective rectangular pieces 12 are press-formed into the shapes of the terminal as described with reference to FIGS. 1A to 1F, when the terminal chain 30 that slides towards the right direction of FIG. 2B are carried sequentially by the die blocks M1 to M5. FIG. 3 shows a perspective view of the terminal chain of the embodiment of the invention. As shown in FIG. 3, at a certain time, it is found that the shape of a rectangular piece 12 becomes closer to the shape of the terminal as the terminal chain moves towards the right direction of the figure.

In addition, the wire accommodating grooves 42 are formed in positions corresponding to the positions of the rectangular piece bases 412 after the die block M3. In more detail, the positions of the wire accommodating grooves 42 are so determined that the signal conductor W1 of the wire W that is carried in a wire accommodating groove 42 is substantially located in the center of the corresponding rectangular piece base 412. When the wire W is carried on the wire accommodating groove 42, the signal conductor W1 of the wire W1 can be carried on the rear end part of the rectangular piece body 121 which is press-formed by the die block M3 to be opened at the top. After the signal conductor W1 of the wire W is carried on the rear end part of the rectangular piece body 121, since it is necessary to move in such a state to the following die blocks, the other wire accommodating grooves 42 are formed similarly in positions corresponding to the positions of the rectangular piece bases 412 of the die blocks M4 and M5.

In addition, in the embodiments of the invention, although it is described that the rectangular piece 12 is formed to the shape of a terminal by five press-forming processes in which the dies M1-M5 are used, the number of the processes is not limited to 5. Needless to mention the increase of the number of the processes, it is applicable as long as the die block for press-disconnecting to form the shape of the rectangular piece 12, the die block for press-forming to form the shape of the terminal, and the die block for press-disconnecting to disconnect the carrier link 122 are included.

The die blocks as described above have shapes that can be embedded in the terminal accommodating groove 41, are suitable die blocks necessary to press-form the rectangular piece 12, and can press-form the terminal to a shape in accordance with the specification when they are embedded in the terminal accommodating groove 41.

On the other hand, wire accommodating grooves 52 for accommodating wires W to prevent the wires W from being crushed when the upper die 50 falls onto the lower die 40, and bosses 53 which are fitted to the boss holes of the lower die 40 are formed in the upper die 50. Further, die blocks, which correspond to the respective die blocks of the lower die 40, are installed at the bottom of the upper die 50 in positions corresponding to the respective die blocks (not shown in the figure) . The die blocks of the upper metal mould 50 also have shapes that can be embedded, are suitable die blocks necessary to press-form the rectangular piece 12, and can press-form the terminal to a shape in accordance with the specification when they are embedded.

Above, according to the terminal chain of the embodiment of the invention, the process for press-forming the rectangular piece 12 to the shape of a terminal and the process for connecting the signal conductor W1 of the wire W with the terminal can be performed at the same time. In other words, it is not necessary to remove from the die the terminal which is formed by press-forming, and place the terminal in a terminal crimping device which includes an anvil and a crimper, as conventional. For this reason, the producing of wires to which terminals are attached can be improved, and a higher operating efficiency can be achieved.

In the embodiment of the invention, a method was described in which after the nearly half part of the rectangular piece body 121 that is near the front end side is closed by the die block M3, and the nearly half part of the rectangular piece body 121 that is near the rear end side is closed by the die block M4 when the signal conductor W1 of the wire W is carried on the rear end part of the rectangular piece body 121. The signal conductor W1 can be definitely carried on the rectangular piece body 121 by forming in advance a receiving part for receiving the signal conductor W1. As another example of using the receiving part, for example, it is also possible that after the rectangular piece 12 is formed to a substantial U shape when the part beside the center of the rectangular piece is erected by the die block M2 from the two side of the center of the rectangular piece body 121, the rectangular piece body 121 is closed as a whole when the signal conductor W1 of the wire W is carried on the rear end part of the rectangular piece body 121. On the other hand, it is not necessary to configure with such receiving part. For example, it is also possible that after the rectangular piece 12 is formed by being press-disconnected by the die block M1, the rectangular piece body 121 is press-formed to be closed as a whole when the signal conductor W1 of the wire W is carried on the rear end part of the rectangular piece body 121.

Second Embodiment

In the first embodiment, as shown in FIGS. 1 and 2, when the front end of the signal conductor W1 of the wire W is carried on the rear end part of the rectangular piece 12 (part far from the carrier 11), the wire W does not cross the carrier 11, or in other words, the rectangular piece 12 is hold between the carrier 11 and the wire W. When the wire W is carried on the rectangular piece 12 without crossing the carrier 11 as in the first embodiment, the wire W is hold by the carrier 11 and the dies during the process of press-forming. Since it is not necessary to consider the problem of being crushed, the shapes of the lower die 40 and the upper die 50 can be very simple. Further to say, the longer the diameter of wire W becomes, the more necessary it to consider that the wire W is sandwiched by the carrier 11 and the dies. But it is not any more. On the other hand, in the first embodiment in which the wire W is carried on the rectangular piece 12 without crossing the carrier 11, the disconnecting position of the carrier 11 and the rectangular piece 12 (in other words, a part of the carrier link 122) is located at the front end of the terminal 20. Therefore, a burr that would hinder efficient contact of the front end of the terminal 20 with the counterpart terminal is inevitably formed.

Thus, in the second embodiment of the invention, a terminal chain 80 in which a burr formed by disconnecting the carrier would be formed at the rear end of a terminal, and terminals 70 constructing the terminal chain 80 are described.

Figure 4A:
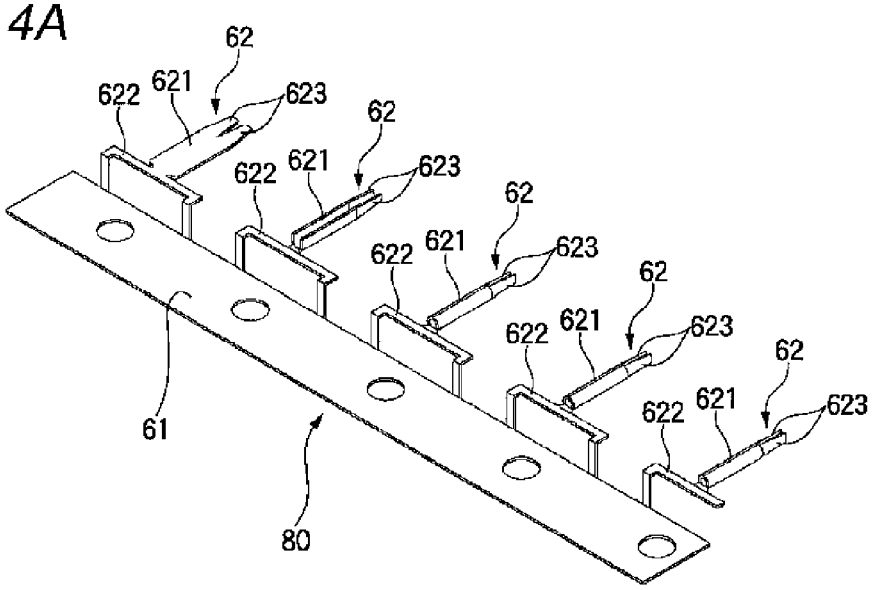
FIGS. 4A and 4B are perspective views of a terminal chain of the second embodiment of the invention.
Figure 4B:
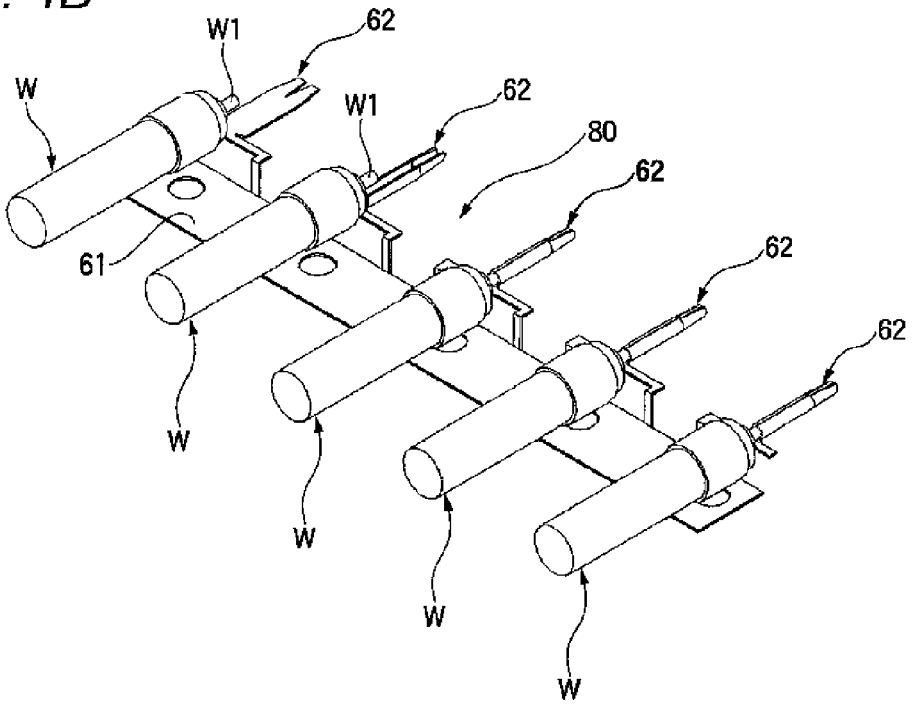

Similar to the first embodiment, in accordance with the aligned die blocks, the terminals 70 of the second embodiment are press-formed to the shapes of the terminal as shown by the respective rectangular pieces 62 in FIGS. 4A and 4B, when the sliding terminal chain 80 is carried sequentially on the die blocks. Next, the forming processes of a terminal of the second embodiment of the invention, together with change of the shape of the terminal, are explained with reference to FIGS. 4A and 4B.

First, a belt-shaped carrier 61 and a rectangular piece 62 which is connected to an end part extending in the longitudinal direction of the carrier 61 are formed by placing a flat metal plate in a die block M11 for press-disconnecting and pressing the flat metal plate. Then, the rectangular piece 62 is constructed of a rectangular piece body 621 which is press-formed to encloses a signal conductor of a wire to conduct with the signal conductor, a carrier link 622 which joints the rectangular piece body 621 and the carrier 61, and contacts 623 which extend from one end of the rectangular piece body 621 opposite to the end that is connected to the carrier link 622 towards a direction away from the carrier 61. Thereafter, for the rectangular piece 62 which is jointed to the carrier 61 through the carrier link 622, a side which is far from the carrier 61 is called the front end side, and a side which is near the carrier 61 is called the rear end side (please note that they are different from the definitions of the front end side and the rear end side of the first embodiment). The carrier link 622 is divided into two parts from the rear end side of the rectangular piece body 621, and the two parts are connected to the carrier 61, respectively. The carrier link 622 is shaped so that a part of the carrier link 622 is folded vertically from the horizontal plane containing the rectangular piece body 621. Thus, the rectangular piece body 621 is located in a position higher than the horizontal plane containing the carrier 61. The difference between the height of the rectangular piece body 621 and that of the carrier 61 corresponds to the size of the diameter of the wire carried on the rectangular piece body 621, more specifically, half of the wire diameter. In addition, the contacts 623 are two contacts that extend from the two sides of the rectangular piece body 621 towards a direction away from the carrier 61. When the rectangular piece 62 becomes a terminal, the contacts 623 will form the front end of the terminal (a portion in contact with a counterpart terminal).

Thereafter, the rectangular piece 62 which is press-disconnected by the die block M11 is placed in a die block M12 for press-forming and is pressed. Then, in the rectangular piece 62, the two parts beside the center of the rectangular piece body 621 and the two contacts 623 are folded towards the center of the rectangular piece body 621. Then, the rectangular piece 62 is formed to have a cross section of a substantial U shape whose bottom edge is the center part of the rectangular piece body 621, and the parts beside the center part of the rectangular piece body 621 are erected from the two sides of the center part, respectively.

Figure 5A:
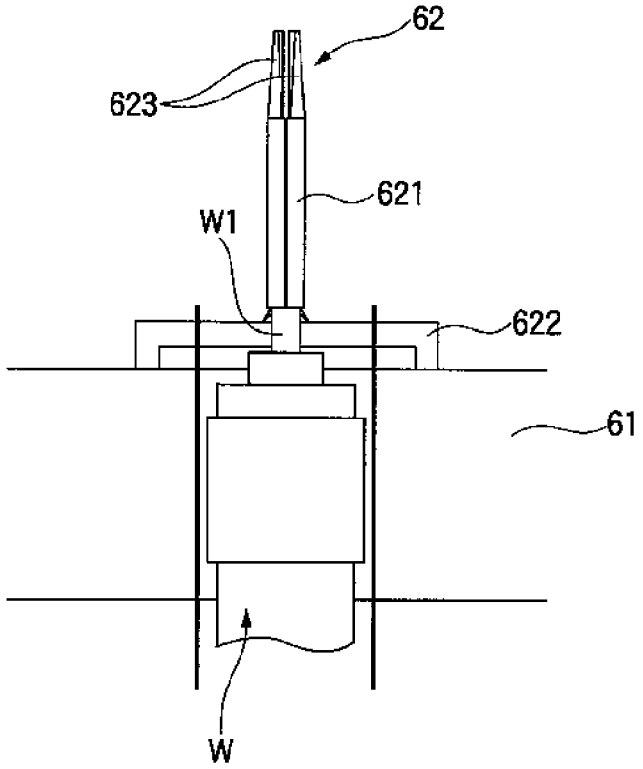
FIGS. 5A and 5B are top views of the terminal chain of the second embodiment of the invention.

After the rectangular piece 62 is formed to a substantial U shape when the parts beside the center of the rectangular piece are erected by the die block M12 from the two sides of the center of the rectangular piece body 621, the signal conductor W1 exposed at one end of the wire W is placed on the rear end of the rectangular piece body 621. Then, the wire W, as shown by the top view of the terminal chain of the second embodiment of the invention of FIG. 5A, is so placed that the wire W crosses the carrier 61 while the signal conductor W1 crosses the carrier link 622. Even when the wire W is placed as above, since the difference between the height of the rectangular piece body 621 and that of the carrier 61 is half of the diameter of the wire W, in the process of carrying the signal conductor W1 on the rectangular piece body 621, the wire W contacts with the carrier 61 before the signal conductor W1 contacts with the rectangular piece body 621 and the carrier link 622. Thus, the contact of the signal conductor W1 with the rectangular piece body 621 and the carrier link 622 will not be hindered.

Thereafter, the rectangular piece 62, whose rectangular piece body 621 carries the signal conductor W1, is placed in a die block M13 for press-forming and is pressed. Then, the rectangular piece body 621 of the rectangular piece 62 in which the signal conductor W1 of the wire W is placed is totally closed. In other words, the rectangular piece body 621 is formed by making close the two parts beside the center part of the rectangular piece body 621.

Figure 5B:
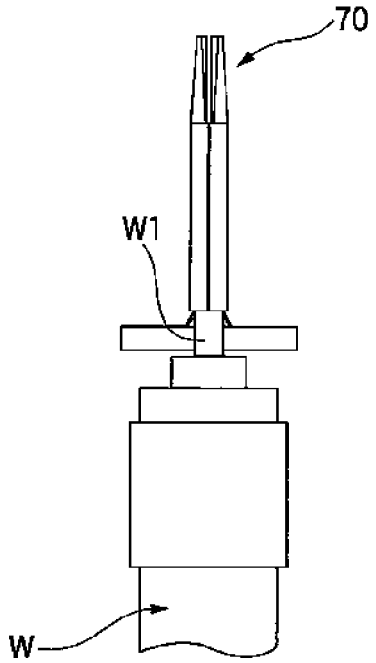

Through the processes described above, the signal conductor W1 of the wire W is connected to the rectangular piece body 621, and the rectangular piece 62 is formed to the shape of a terminal at the same time. Then, the rectangular piece 62 which is press-formed by the die block M13 is placed in a die block M14 for press-disconnecting, and the carrier 61 and the carrier link 622 are disconnected at the carrier disconnecting positions as shown in FIG. 5A, that is, the disconnecting surfaces are located at the two sides of the wire W and in parallel with the longitudinal direction of the wire W. When the terminal 70 is formed by disconnecting as above, as shown in FIG. 5B, a part of the carrier link 622 which can be regarded as a part of the carrier is formed to the rear end of the terminal 70. Thus, a terminal 70 which is connected to the signal conductor W1 of the wire W is formed.

Above, according to the terminal chain of the second embodiment of the invention and the terminals constructing the terminal chain, the e for press-forming the rectangular piece 62 to the shape of a terminal and the process for connecting the terminal with the signal conductor W1 of the wire W can be performed at the same time. In other words, it is not necessary as before to remove from the die the terminal which is formed by press-forming, and place the terminal in a terminal crimping device which includes an anvil and a crimper. For this reason, the producing of wires to which terminals are attached can be improved, and a higher operating efficiency can be achieved.

In addition, since the disconnecting position of the carrier 61 and the rectangular piece 62 is located at the rear end of the terminal 70, burrs that are formed during the process of disconnecting are also formed at the rear end of the terminal 70. As a result, the burrs that would hinder efficient contact of the front end of the terminal 70 with the counterpart terminal can be prevented from forming.

Further, since the height of the rectangular piece body 621 is provided to be different from that of the carrier 61, the wire W is hold by the carrier 61 and the dies during the process of press-forming, and will not be crushed.

Third Embodiment

In the third embodiment, a terminal chain 110 in which a burr formed by disconnecting the carrier would be formed at the rear end of a terminal, and terminals 100 constructing the terminal chain 80 are described. In the second embodiment, the wire W is hold by the carrier 61 and the dies. In order to avoid the problem of being crushed, the height of the rectangular piece body 621 is provided to be different from that of the carrier 61. In order to avoid the same problem, the third embodiment is characterized in dimensions in the width direction of the carrier 61.

Figure 6A:
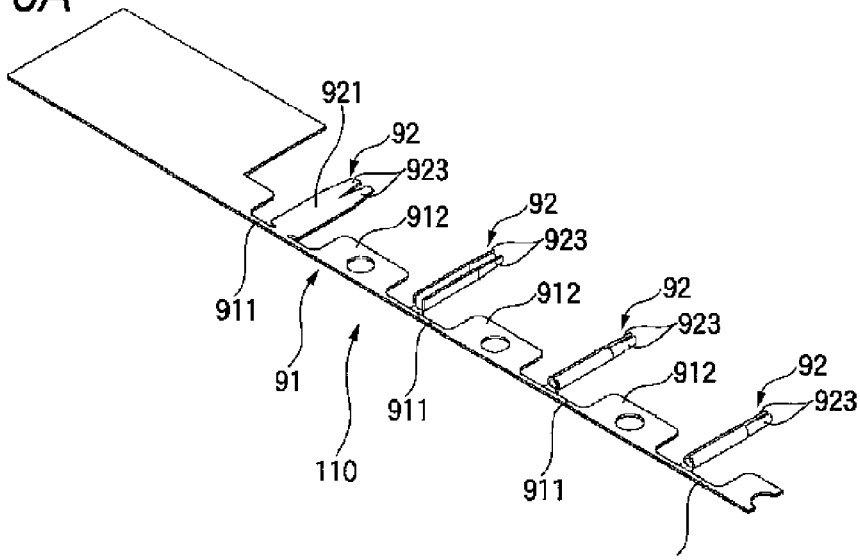
FIGS. 6A and 6B are perspective views of a terminal chain of the third embodiment of the invention.
Figure 6B:
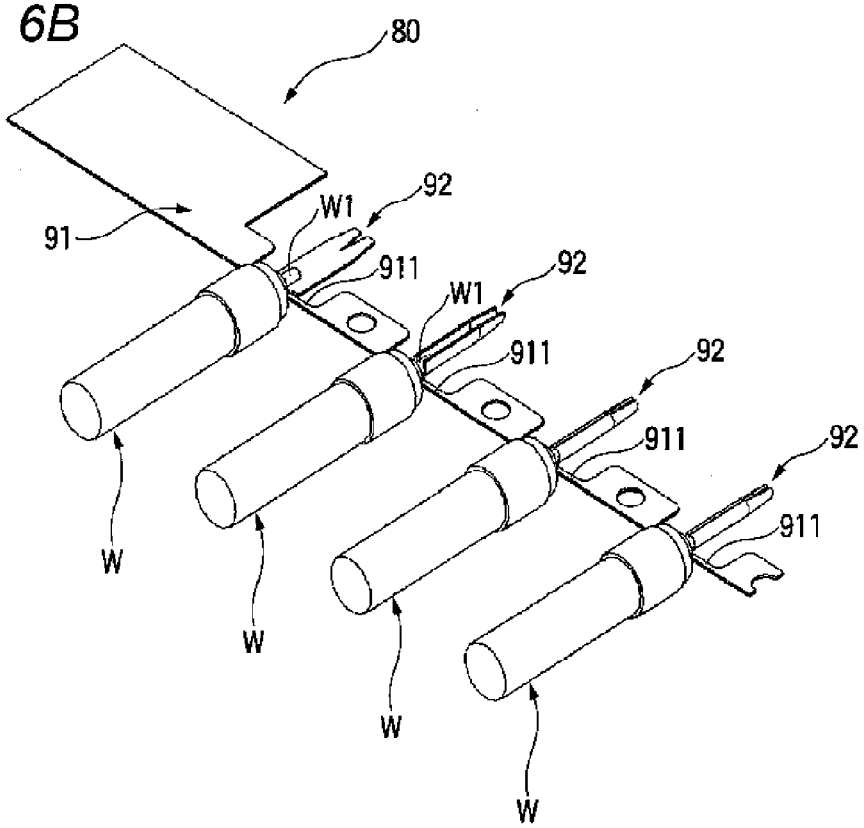

Similar to the first and the second embodiments, in accordance with the aligned die blocks, terminals 100 of the third embodiment are press-formed to the shapes of the terminal as shown in FIGS. 6A and 6B by the respective rectangular pieces 92 by carrying a sliding terminal chain 110 sequentially on the die blocks. Next, the forming processes of the terminal of the third embodiment of the invention, together with change of the shape of the terminal, are explained with reference to FIGS. 6A and 6B.

First, a jagged shaped carrier 91 with narrow parts 911 whose width is short and wide parts 912 whose width is long alternately aligned in the longitudinal direction and a rectangular piece 92 which is connected to a narrow part 911 among the end parts extending in the longitudinal direction of the carrier 91 are formed by placing a flat metal plate in a die block M21 for press-disconnecting and pressing the flat metal plate. The width of the narrow parts 911 of the carrier 91 is shorter than the length in the longitudinal direction of a signal conductor W1 which is exposed at one end of the wire W, and the width of wide parts 912 is longer than the width of the narrow parts 911. The narrow parts 911 and the wide parts 912 are connected alternately and aligned at one side in their width direction. In the third embodiment, although the width of the wide parts 912 is longer than the width of the narrow parts 911, any width is possible as long as the width of the carrier 91 at the part that is connected to the rectangular piece 92 (corresponding to the narrow part 911 in the third embodiment) is shorter than the length in the longitudinal direction of the signal conductor W1 which is exposed at one end of the wire W. Further, in the third embodiment, although it is described that the narrow parts 911 and the wide parts 912 are connected and aligned at one side in their width direction, the invention is not limited in terms of the connecting positions of the narrow parts 911 and the wide parts 912.

In addition, the rectangular piece 92 is constructed of a rectangular piece body 921 which is press-formed to enclose a signal conductor of a wire to conduct with the signal conductor, and contacts 923 which extend from one end of the rectangular piece body 921 opposite to the end that is connected to the carrier 91 towards a direction away from the carrier 91. Thereafter, for the rectangular piece 92 which is jointed to the carrier 91, a side which is far from the carrier 91 is called the front end side, and a side which is near the carrier 91 is called the rear end side. (Please note that they are different from the definitions of the front end side and the rear end side of the first embodiment.) The contacts 923 are two contacts that extend from the two sides of the rectangular piece body 921 towards a direction away from the carrier 91. When the rectangular piece 92 becomes a terminal, the contacts 923 will form the front end of the terminal (a portion in contact with a counterpart terminal).

Then, the rectangular piece 92 which is press-disconnected by the die block M21 is placed in a die block M22 for press-forming and is pressed. Then, in the rectangular piece 92, the two parts beside the center of the rectangular piece body 921 and the two contacts 923 are folded towards the center of the rectangular piece body 921. Then, the rectangular piece 92 is formed to have a cross section of a substantial U shape whose bottom edge is the center part of the rectangular piece body 921, and the parts beside the center part of the rectangular piece body 921 are erected from the two sides of the center part, respectively.

Figure 7A:
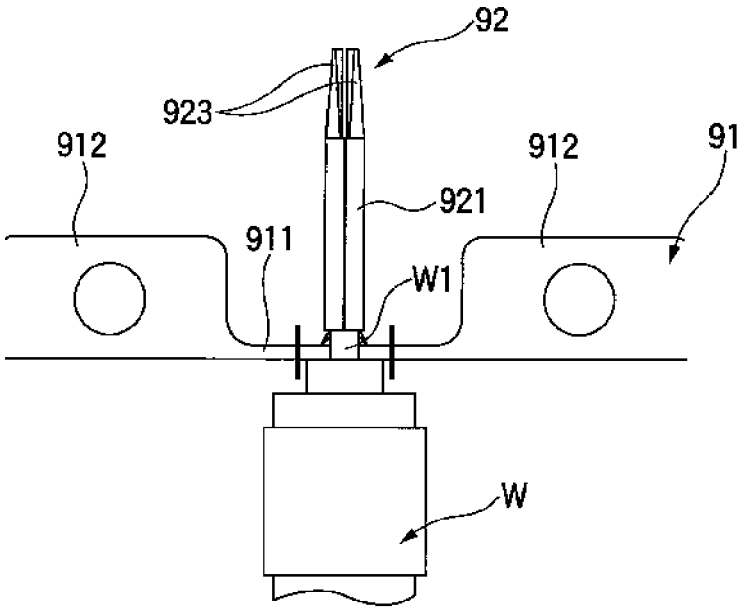
FIGS. 7A and 7B are top views of the terminal chain of the third embodiment of the invention.

Further, after the rectangular piece 92 is formed to a substantial U shape when the parts beside the center of the rectangular piece are erected by the die block M22 from the two sides of the center of the rectangular piece body 921, the signal conductor W1 exposed at one end of the wire W is placed on the rear end of the rectangular piece body 921. Then, the wire W, as shown by the top view of the terminal chain of the third embodiment of the invention of FIG. 7A, is so placed that the signal conductor W1 which is exposed at one end of the wire W crosses the narrow part 911. When the wire W is placed on the carrier 91 in this way, the wire W will not contact with the carrier 91.

Thereafter, the rectangular piece 92, whose rectangular piece body 921 carries the signal conductor W1, is placed in a die block M23 for press-forming and is pressed. Then, the rectangular piece body 921 of the rectangular piece 92 on which the signal conductor W1 of the wire W is placed is totally closed. In other words, the rectangular piece body 921 is formed by making close the two parts beside the center part of the rectangular piece body 921.

Figure 7B:
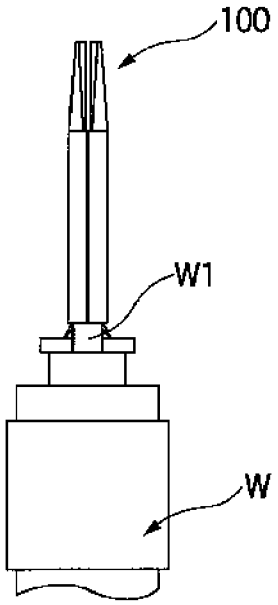

Through the processes described above, the signal conductor W1 of the wire W is connected to the rectangular piece body 921, and the rectangular piece 92 is formed to the shape of a terminal at the same time. Then, the rectangular piece 92 which is press-formed by the die block M23 is placed in a die block M24 for press-disconnecting, and the narrow part 911 of the carrier 911 is disconnected at the carrier disconnecting positions as shown in FIG. 7A, that is, the disconnecting surfaces are located at the two sides of the signal conductor W1 of the wire W and in parallel with the longitudinal direction of the wire W. When the terminal 100 is formed by disconnecting as above, as shown in FIG. 7B, a part of the narrow part 911 which can be regarded as a part of the carrier is formed to the rear end of the terminal 100. Thus, a terminal 100 which is connected to the signal conductor W1 of the wire W is formed.

Above, according to the terminal chain and the terminals constructing the terminal chain of the third embodiment of the invention, the process for press-forming the rectangular piece 92 to the shape of a terminal and the process for connecting the terminal with the signal conductor W1 of the wire W can be performed at the same time. In other words, it is not necessary as before to remove from the die the terminal which is formed by press-forming, and place the terminal in a terminal crimping device which includes an anvil and a crimper. For this reason, the producing of wires to which terminals are attached can be improved, and a higher operating efficiency can be achieved.

In addition, since the disconnecting positions of the carrier 91 and the rectangular piece 92 are located at the rear end of the terminal 100, burrs that are formed during the process of disconnecting are also formed at the rear end of the terminal 100. As a result, the burrs that would hinder efficient contact of the front end of the terminal 100 with the counterpart terminal can be prevented from forming.

Further, since the signal conductor W1 is carried on the rectangular piece 92 which is connected to the narrow part 911 of the carrier 91, the wire W is hold by the carrier 91 and the die during the process of press-forming, and will not be crushed.

Although the present invention is described in detail with reference to the embodiments, it is apparent that various modifications and amendments may be made by those skilled in the art without departing from the spirit and scope of the invention.

This application is based on the Japanese patent application No. 2009-179091 filed on Jul. 31, 2009, whose content is incorporated herein by way of reference.

REFERENCE SIGNS LIST

11, 61, 91 carrier
12, 62, 92 rectangular piece
121, 621, 921 rectangular piece body

122, 622 carrier link
123, 623, 923 contact
20, 70, 100 terminal
30, 80, 110 terminal chain
40 lower die
50 upper die
911 narrow part
912 wide part
W wire
W1 signal conductor

What is claimed is:

1. A manufacturing method for manufacturing a terminal connected with a wire by sliding a flat metal plate to be press-formed by die blocks, the method comprising:

press-disconnecting the flat metal plate to form a rectangular piece that is connected to a carrier that extends in a longitudinal direction; and press-forming the rectangular piece to enclose a signal conductor that is exposed at one end of a wire, wherein the press-forming connects the signal connector to the rectangular piece without crimping by an anvil and a crimper.

2. The manufacturing method for manufacturing a terminal connected with a wire as set forth in claim 1, further comprising:

positioning the signal conductor on the rectangular piece;

connecting the signal conductor with the rectangular piece by press-forming the rectangular piece to enclose the signal conductor; and forming the terminal connected with the wire by press-disconnecting a connecting portion where the carrier and the rectangular piece are connected.

3. A manufacturing method for manufacturing a terminal connected with a wire by sliding a flat metal plate to be press-formed by die blocks, the method comprising:

press-disconnecting the flat metal plate to form a rectangular piece that is connected to a carrier that extends in a longitudinal direction;

positioning the signal conductor on the rectangular piece;

press-forming the rectangular piece to enclose a signal conductor that is exposed at one end of a wire, so that the signal connector is connected to the rectangular piece;

forming the terminal connected with the wire by press-disconnecting a connecting portion where the carrier and the rectangular piece are connected wherein the carrier and the rectangular piece are formed by press-disconnecting the metal plate with a first die block, the signal conductor is placed on the rectangular piece positioned on a second die block for press-forming the rectangular piece, the signal conductor is connected to the rectangular piece by press-forming with the second die block, and the terminal connected with the wire is formed by press-disconnecting the connecting portion with a third die block for press-disconnecting the connecting portion connecting the carrier and the rectangular piece.

4. The manufacturing method for manufacturing a terminal connected with a wire as set forth in claim 3, the method further comprising:

positioning the rectangular piece on a fourth die block for press-forming the rectangular piece and press-forming, after press-disconnecting the flat metal plate and before positioning the signal conductor on the rectangular piece, the rectangular piece so that two side portions become close at a front end portion of the rectangular piece close to the carrier and two side portions become erected from a center part of the rectangular piece at a rear end portion of the rectangular piece far from the carrier, wherein positioning the signal conductor on the rectangular piece comprises positioning the signal conductor on the rear end side of the rectangular piece positioned at the second die block, connecting the signal conductor with the rectangular piece comprises press-forming the rear end side of the rectangular piece by using the second die block, so that the rectangular piece is formed to make the two side portions close at the rear end side of the rectangular piece, and the signal conductor is connected to the rectangular piece, and forming the terminal connected with the wire comprises press-disconnecting the connection portion connecting the carrier and the front end side of the rectangular piece with the third die block.

5. The manufacturing method for manufacturing a terminal connected with a wire as set forth in claim 3, wherein positioning the signal conductor on the rectangular piece comprises positioning the signal conductor at a rear end side of the rectangular piece so that the wire or the signal conductor is positioned to cross the carrier, and forming the terminal connected with the wire comprises press-disconnecting the terminal connected with the wire by press-disconnecting the connection portion connecting the carrier and the rear end side of the rectangular piece with the third die block.

* * * * *